US005555853A

United States Patent [19]

Bowen et al.

[11] Patent Number: 5,555,853

[45] Date of Patent: Sep. 17, 1996

[54] LIGHTWEIGHT BACK-PACK GENERATOR SET HAVING A SPARK-IGNITED ENGINE OPERATING ON MIDDLE DISTILLATE FUELS

[76] Inventors: Douglas M. Bowen, 6626 Riggs, Overland Park, Kans. 66202; Clint D. Gray, 1105-20 Deerfield Dr., Nepean, Ontario, Canada; Douglas E. Campbell, 10608 W. 126th Terr.,, Overland Park, Kans. 66213; David Collier, 6058 Malakoff Rd., RR 3, Richmond, Ontario, Canada; Steven L. Hickman, 15000 E. 39th Ter., Independence, Mo. 64055; Norman J. Hole, Box 517, 6215 Dunning Rd., Vars, Ontario, Canada; Norman J. Kessens, 2224 NW. 12th St., Blue Springs, Mo. 64015; Gary D. Webster, 76 Blackburn Ave., Ottawa, Ontario, Canada; John H. Walker, 12015 Overbrook Rd., Leawood, Kans. 66209; Daniel L. Walters, 513 Brad Cir., Blue springs, Mo. 64014

[21] Appl. No.: 219,096

[22] Filed: Mar. 29, 1994

[51] Int. Cl.[6] ..... F02M 31/00; F02B 63/04

[52] U.S. Cl. ..... 123/2; 123/550

[58] Field of Search ..... 123/1 A, 2, DIG. 7, 123/169 EL, 41.56, 41.69, 595, 557, 549, 543, 73 C, 556, 298, 48 A, 246; 290/14, 17, 22, 1 R, 1 A, 1 C; 180/2.1, 2.2; 310/216, 256, 266, 67 R

[56] References Cited

U.S. PATENT DOCUMENTS

| | | | |
|---|---|---|---|
| 3,685,498 | 8/1972 | Shrewsbury et al. | 123/246 |
| 4,223,652 | 9/1980 | Budnicki | 123/557 |
| 4,245,589 | 1/1981 | Ryan | 123/298 |
| 4,539,815 | 9/1985 | Garcea | 123/556 |
| 4,548,186 | 10/1985 | Yamaji et al. . | |
| 4,595,841 | 6/1986 | Yaguchi . | |
| 4,608,946 | 9/1986 | Tanaka et al. | 123/2 |
| 4,647,835 | 3/1987 | Fujikawa et al. . | |
| 4,761,209 | 8/1988 | Bonaventura et al. | 123/2 |
| 4,770,136 | 9/1988 | Newman | 123/48 A |
| 4,835,405 | 5/1989 | Clancey et al. . | |
| 4,898,135 | 2/1990 | Failla et al. . | |
| 5,010,870 | 4/1991 | Laskaris et al. | 123/1 A |
| 5,042,442 | 8/1991 | Laskaris et al. | 123/73 C |
| 5,076,247 | 12/1991 | Schmidt et al. . | |
| 5,133,300 | 7/1992 | Miura | 123/2 |
| 5,411,005 | 5/1995 | Bohl et al. | 123/557 |

FOREIGN PATENT DOCUMENTS

| | | |
|---|---|---|
| 107689 | 7/1917 | United Kingdom . |
| 133082 | 10/1919 | United Kingdom . |
| 150975 | 3/1922 | United Kingdom . |
| 187174 | 10/1922 | United Kingdom . |
| 195939 | 2/1923 | United Kingdom . |

OTHER PUBLICATIONS

SAE International, "SP–849 Two–Stroke Engine Design and Development," dated Feb. 1991, pp. 1–111.

(List continued on next page.)

*Primary Examiner*—Marguerite McMahon
*Attorney, Agent, or Firm*—Fried, Frank, Harris, Shriver & Jacobson

[57] ABSTRACT

A lightweight back-pack generator set having a spark-ignited engine operating on middle distillate fuels (e.g., JP-5, JP-8 and F-34) has been provided. The generator set includes a back-pack frame; an alternator; and a spark-ignited combustion engine adapted to operate on a middle distillate fuel. The engine uses a preheater for heating the intake manifold to facilitate start-up operation of the engine. The present invention also provides a simple and inexpensive method for converting a spark-ignited gasoline engine to operate on a middle distillate fuel for providing a lightweight engine suitable for driving an alternator, a portable generator, or other portable equipment.

50 Claims, 8 Drawing Sheets

OTHER PUBLICATIONS

Dayton Electric Manufacturing Co., "Models 4W108A, 4W109A, 5W260, 5W261, and 5W262 Sport and Home Generators Operating Instructions & Parts Manual," undated.

C. C. Failla et al., "Kerosene Base Fuels in Small Gasoline Engines," Sonex Research, Inc., dated 1991.

Kawasaki, "FA76, FA130, FA210 4–Stroke Air–Cooled Gasoline Engine Workshop Manual," undated.

W. M. Scott, "Looking In On Diesel Combustion," dated 1969, pp. 33–49.

W. R. Matthes et al., "Effects of the Degree of Fuel Atomization on Single Cylinder Engine Performance," dated 1975, pp. 414–434.

B. W. Millington, "The Nature and Cause of Diesel Emissions," *Proceedings Inst. Mech. Engrs. vol. 183, pt 3E,* pp. 152–53, dated 1969.

B. J. Stroia et al., "The Use of Auxiliary Ignition Devices To Improve Combustion of Low Octane–High Volatility Fuels in a Diesel Engine," *SAE Technical Paper Series,* No. 80428, pp. 1–16, dated 1988.

B. Enright et al., "A Critical Review of Spark–Ignited Diesel Combustion," undated, pp. 1–17.

R. G. Phatak et al., "Investigation of a Spark–Assisted Diesel Engine," SAE Technical Paper Series, No. 830588, dated 1983, pp. 1–8.

LIGHTWEIGHT BACK-PACK GENERATOR SET HAVING A SPARK-IGNITED ENGINE OPERATING ON MIDDLE DISTILLATE FUELS

BACKGROUND OF THE INVENTION

This invention relates to a generator set employing a spark-ignited engine capable of operating on middle distillate fuels such as kerosene-type fuels. More particularly, this invention relates to a lightweight, back-pack generator set employing a spark-ignited gasoline engine converted to operate on middle distillate fuels.

The military as well as civilian counterparts have long used gasoline-powered generator sets as a source of portable electrical power. Such generator sets, however, suffer from a number of drawbacks. First, gasoline engines can be unsafe due to the combustion characteristics of gasoline, particularly its self-ignition and flammability characteristics. Second, some militaries units have been attempting to adopt kerosene-based fuels as their single source of fuel so as to eliminate the need for providing conventional gasoline to remote locations in the field. Third, in some parts of the world, kerosene-based fuels are more readily available than gasoline.

Although engine technology has generally kept pace with the demand for high-power (greater than 5 kW), high-efficiency, combustion engines which run on kerosene-type fuels, there is a need for low-cost, lightweight, engines capable of providing 0.5 to 3 kW's of power operable from kerosene-type fuels that is suitable for use in portable generator applications. For example, although conventional diesel engine technology is well-advanced, such engines are generally not suitable or commercially available for light-weight/portable applications. This is partly because of their generally low PMV (power per unit mass per unit volume) due to high compression ratios required to ignite diesel fuels in conventional fashion and consequential greater engine robustness and weight.

In some applications (e.g., military applications) portable generator sets must also be able to operate under a variety of conditions not generally required in commercial applications. For example, military generator sets preferably must be able to start-up and operate in outdoor environments at temperatures from below 0° C. to over 50° C. Furthermore, they must also preferably be able to be operated in positions tilted off the upright position to accommodate operation on rugged terrain. These unique requirements add to the complexity of providing an engine suitable for use in military portable generator sets.

In light of the above, it would be desirable to be able to provide a lightweight generator set which does not suffer from the same drawbacks as gasoline-powered generator sets.

It would also be desirable to be able to provide such a generator set capable of operating on middle distillate fuels such as kerosene-based fuels.

It would further be desirable to be able to provide such a generator set capable of starting and operating at low temperatures.

SUMMARY OF THE INVENTION

It is an object of this invention to provide a lightweight generator set which does not suffer from the same drawbacks as gasoline-powered generator sets.

It is also an object of this invention to provide such a generator set capable of operating on middle distillate fuels such as kerosene-based fuels.

It is a further object of this invention to provide such a generator set capable of starting and operating at low temperatures.

In accordance with this invention there is provided a lightweight, back-pack generator set including a back-pack frame; an alternator with associated output circuitry; and a spark-ignited combustion engine adapted to operate on a middle distillate fuel. The engine includes a preheater for heating the intake manifold to facilitate start-up operation of the engine. The present invention provides a simple and incxpensive method for convening a spark-ignited gasoline engine to operate on a middle distillate fuel for providing a lightweight engine suitable for driving an alternator of a portable generator set.

BRIEF DESCRIPTION OF THE DRAWINGS

The above and other objects and advantages of the invention will be apparent upon consideration of the following detailed description, taken in conjunction with the accompanying drawings, in which like-reference numerals refer to like-parts throughout, and in which.

DETAILED DESCRIPTION OF THE INVENTION

Figure 1:
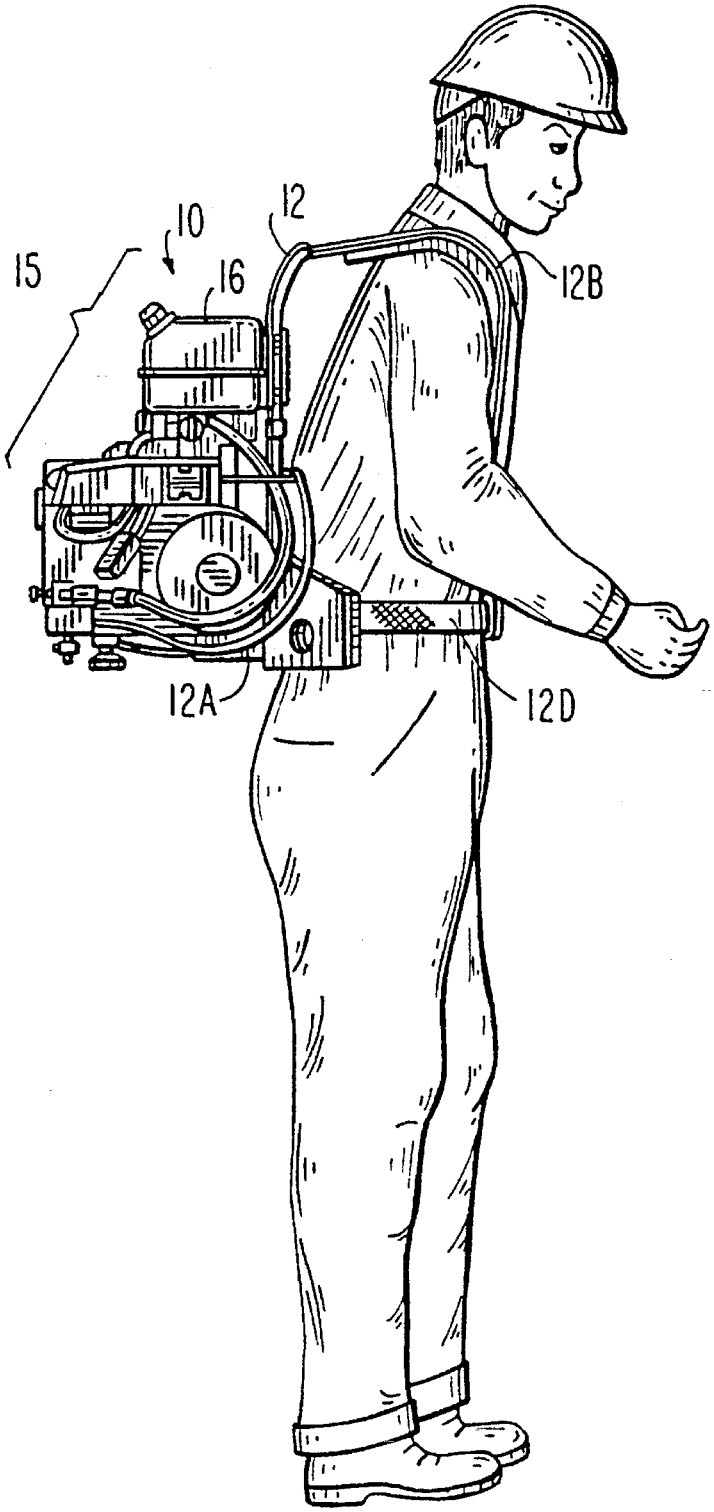
FIG. 1 is schematic view of an embodiment of a portable back-pack generator set in accordance with the present invention.
Figure 2A:
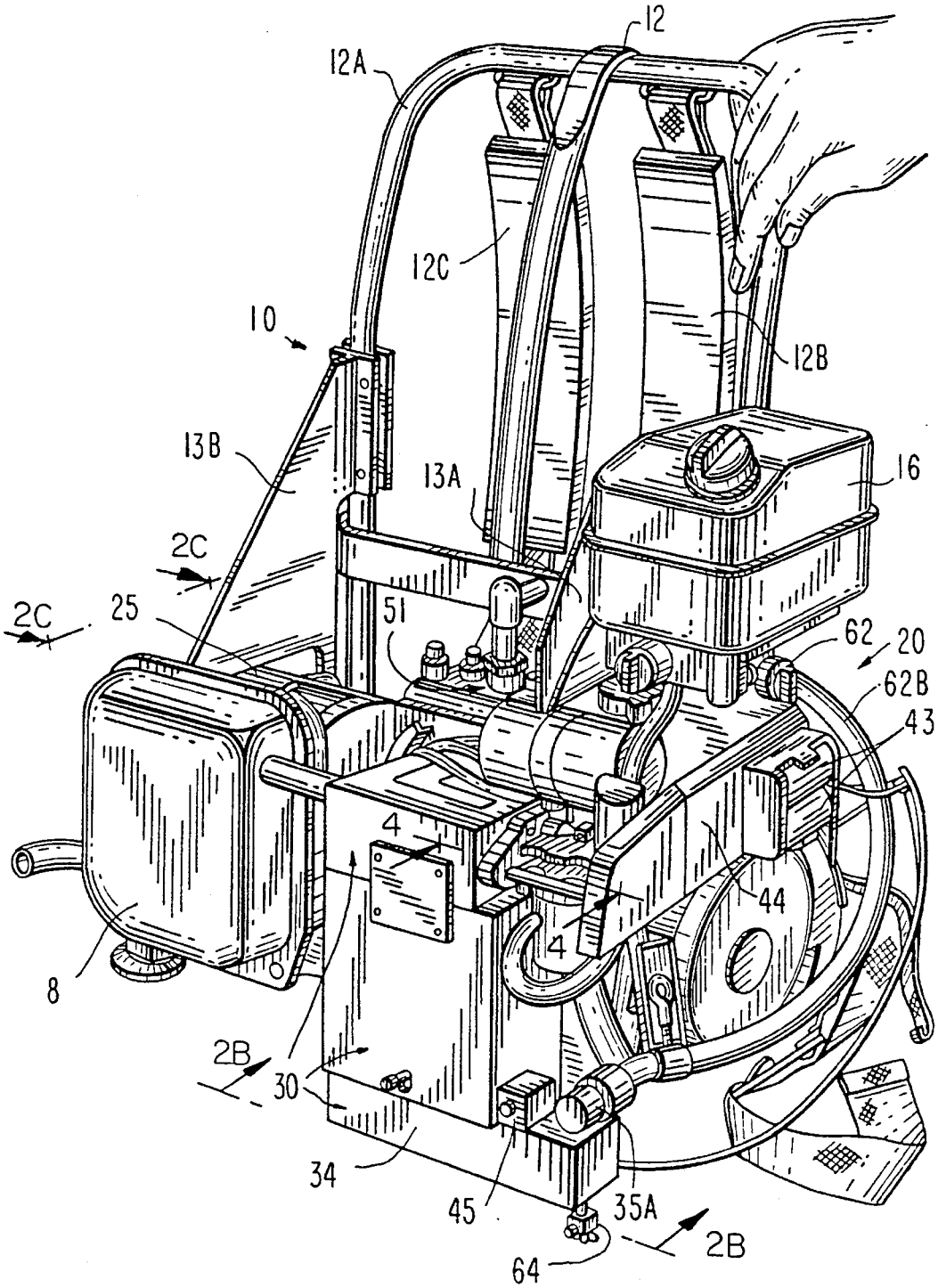
FIG. 2A is a perspective view of the portable back-pack generator set of FIG. 1.
Figure 2B:
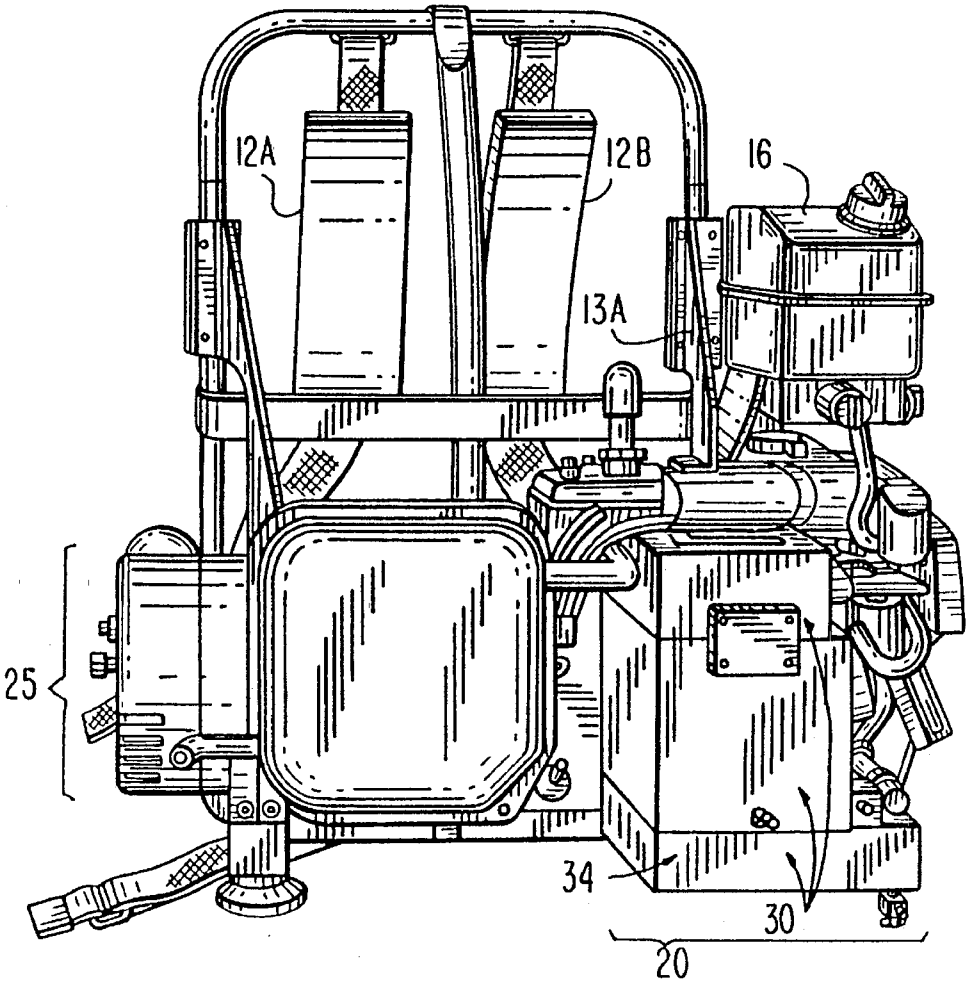
FIG. 2B is front view of the back-pack generator set of FIG. 2A, taken from line 2B—2B of FIG. 2A.
Figure 2C:
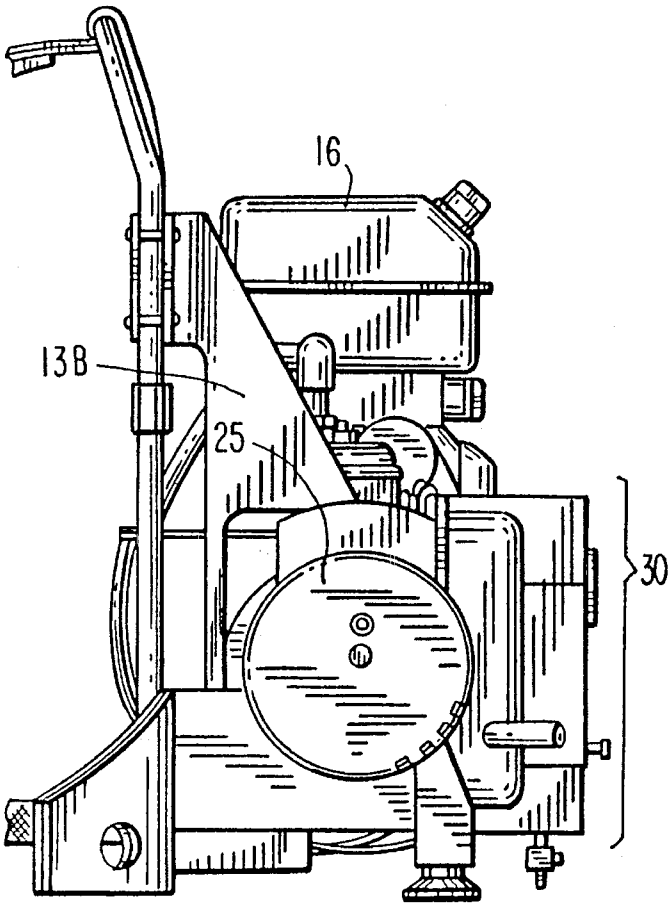
FIG. 2C is a side plan view of the back-pack generator set of FIG. 2A, taken from line 2C—2C of FIG. 2A.
Figure 3A:
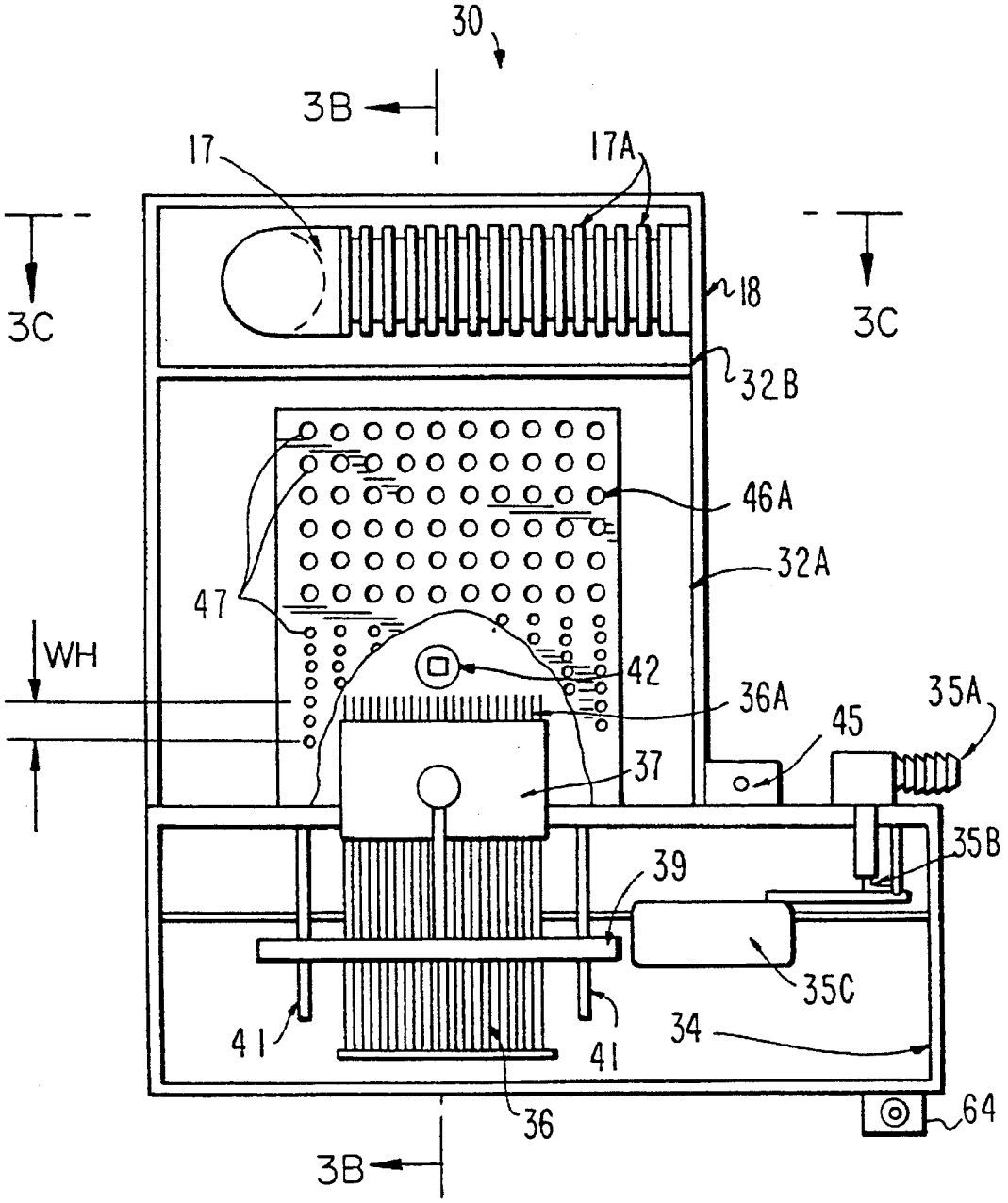
FIG. 3A is a front sectional view of the intake manifold preheater set of FIG. 2A, taken from line 3A—3A of FIG. 3 B.
Figure 3B:
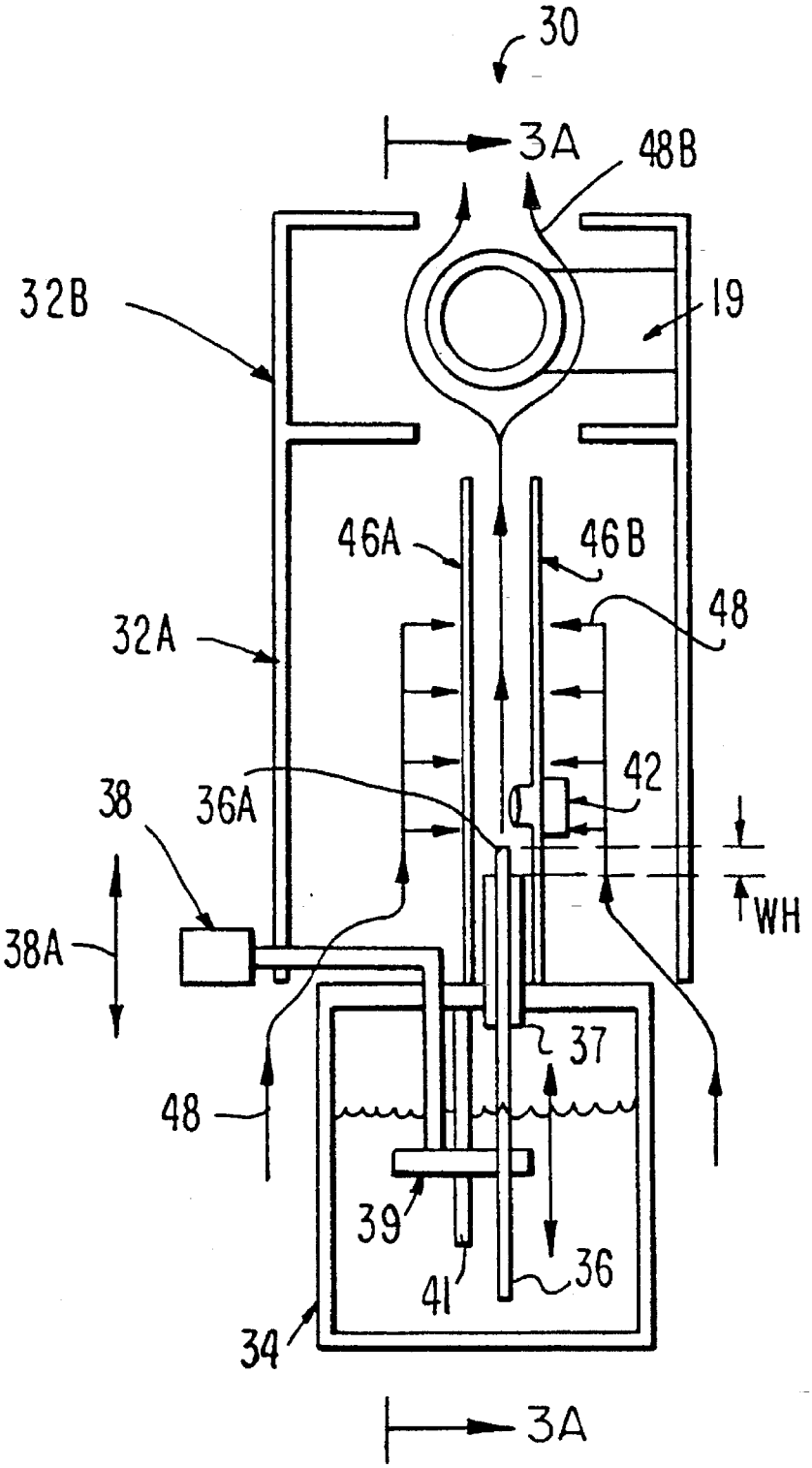
FIG. 3B is a side sectional view of the intake manifold preheater of FIG. 2A, taken from line 3B—3B of FIG. 3A.
Figure 3C:
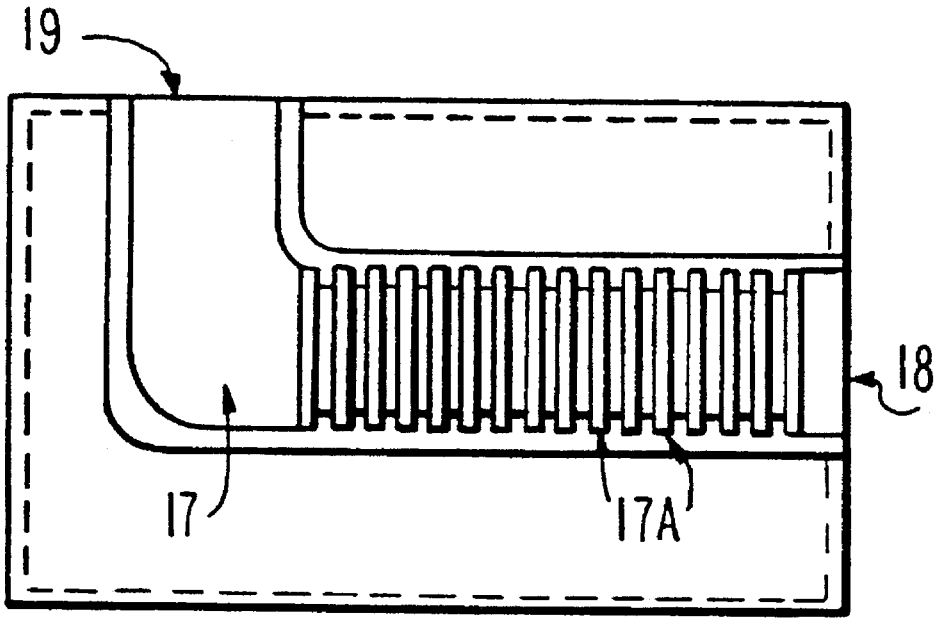
FIG. 3C is a top sectional view of the intake manifold of FIG. 2A, taken from line 3C—3C of FIG. 3A.

The generator set of the present invention is lightweight and easily adaptable for mounting on a back-pack or in a hand-held carrier for providing portable electrical power at remote locations. The generator includes a spark-ignited combustion engine for driving the rotor of an electromotive device which converts mechanical energy into electrical energy. In accordance with the present invention, the electromotive device can be of a conventional alternator design, or, preferably, of a design as disclosed in U.S. Pat. Nos. 4,900,965 and 5,212,419 or co-pending U.S. patent application Ser. No. 08/138,242, filed Oct. 15, 1993, all of which are hereby incorporated by reference in their entireties.

As discussed below, the combustion engine of the present invention is otherwise a conventional light-weight, spark-ignited combustion engine adapted in accordance with the present invention to operate on middle distillate fuels instead of conventional gasoline. In accordance with the present invention, the engine of the present invention includes a low cost, lightweight, intake manifold preheater for facilitating start-up of the engine. The intake manifold preheater operates on the same fuel as the engine (i.e., middle distillate fuel), eliminating the need to provide multiple types of fuel at remote locations for generating electrical power (i.e., one for start-up and a second for continuous combustion). This feature of the present invention is particularly suitable for some military applications where there is a requirement that generator sets operate on a single fuel.

As used herein, "middle distillate fuels" are defined to include those fuels having distillation characteristics at higher temperatures than conventional gasoline. Such fuels include, but are not limited to, kerosene fuels (e.g., JP-8, JP-5 and F-34) and wide-cut gasolines (e.g., JP-4).

FIGS. 1–4 illustrate an embodiment of a portable back-pack generator set in accordance with the present invention. As shown in FIGS. 1–4, generator set 10 includes back-pack 12 adapted for carrying engine/alternator unit 15. Engine/alternator unit 15 includes (1) engine 20 having fuel reservoir 16 for holding a middle distillate fuel and (2) alternator 25. Back-pack 12 includes frame 12A, shoulder straps 12B and 12C (adapted for resting on a user's shoulders) and waist strap 12D (adapted for securing unit 15 to the user's waist). Frame 12A includes brackets 13A and 13B for attaching to engine 20 and alternator 25, respectively. Preferably, frame 12A is made from lightweight metal such as aluminum and weighs less than about 5 lbs.

Engine 20 has a drive shaft (not shown) rotatable by the engine and coupled to alternator 25. Engine 20 can be, for example, a modified Kawasaki® FA76D spark-ignited engine (available before modification from Kawasaki Heavy Industries, Ltd.). This particular engine (before modification as discussed below) is a 1-cylinder, 4-stroke, horizontal shaft, air-cooled gasoline engine having a float-type carburetor with a manual recoil starter and a rated output of about 925 W/3,600 RPM (maximum output of about 1,250 W/4,000 RPM) and a dry weight of approximately 18 lbs.

As discussed above, alternator 25 can be a conventional generator, as shown in FIGS. 1–4, (e.g., a 750 W, 120 volt, single phase, 60 Hz, Model 5W260 generator, available from Dayton Electric Mfg. Co. of Chicago, Ill.) or, preferably, an alternator having a design as disclosed in above-incorporated U.S. Pat. Nos. 4,900,965 and 5,212,419 and application Ser. No. 08/138,242, filed Oct. 15, 1993. As described in the 08/138,242 patent application, such a preferred alternator is compact, lightweight and has high efficiency. For example, the above Dayton® Model 5W260 generator has a weight of approximately 20 lbs, while an alternator in accordance with the design disclosed in the 08/138,242 application has a weight of approximately 6 lbs for a 1 kW rated output with a volume of less than about one-quarter of the Dayton® generator. Thus, in accordance with the present invention, a portable generator set providing over 500 W's of rated power (using the modified Kawasaki® FA76D engine) and having a weight in a range from as low as about 25–30 lbs. to about 45–50 lbs. (depending upon the particular alternators and engines used) has been provided. Such a generator set is particularly suitable for back-pack mounting.

As discussed above, the present invention includes a light-weight, spark-ignited combustion engine adapted to operate on middle distillate fuels instead of conventional gasoline. As shown in FIGS. 2A–2B and 3A–3C, the generator set of the present invention includes a lightweight, low-cost, intake manifold preheater 30 for facilitating start-up of the engine. Intake manifold preheater 30 is used prior to and during engine start-up to heat manifold 17 (see FIG. 3C) by providing a clean-burning flame between combustor plates 46A and 46B (in combustor chamber 32A). In accordance with the present invention, the outer surface of intake manifold 17 is altered from its original smooth design to include heat exchange fins 17A which are used to effectively transfer heat from combustor chamber 32A to intake manifold 17 enclosed within intake manifold chamber 32B. Heat exchange fins 17A are provided by milling the surface of the original intake manifold. Of course, instead of modifying the original intake manifold, a replacement manifold could be used to provide a more efficient set of heat exchange fins of alternative design. If desired, insulation material could be used in manifold chamber 32B to improve heat transfer efficiency.

In accordance with the present invention, by increasing the temperature of manifold 17 during start-up, the combustion engine has been adapted to operate on middle distillate fuels (instead of conventional gasoline which the engine was otherwise designed to operate with). Manifold 17 has input end 18 (FIG. 3C) coupled to carburetor 55 (FIG. 4) which supplies a fuel/air mixture to engine cylinder 51 through intake manifold exit end 19. Because manifold 17 is heated prior to and during start-up, the fuel/air mixture inducted into engine cylinder 51 (through manifold 17) is also heated, thus facilitating spark-ignited combustion of the middle distillate fuel which would otherwise not have been as easily ignited. After start-up of the engine, manifold preheater 30 can be turned off since the engine generates enough internal heat itself to warm up the fuel/air mixture which is inducted into the cylinder.

Preheater 30 includes preheater fuel reservoir 34 (FIG. 3 A) having fuel inlet 35A coupled to generator fuel reservoir 16 (through preheater fuel control valve 62A and preheater fuel line 62B) for supplying fuel to preheater 30 to heat manifold 17. Fiber wick 36 (glass wool; approximately 0.12 inch thick, 2 inches wide and 4 inches long extending into fuel reservoir 34; available in connection with a Kerosun™ Radiant 40 kerosene heater from Cessna International Products, Ltd., of Port Coquitlam, British Columbia, Canada) is disposed in preheater fuel reservoir 34 for providing fuel to wick tip 36A. Needle valve 35B and needle valve float 35C maintain the fuel level in reservoir 34 sufficiently high to facilitate transfer of fuel to wick tip 36A. Wick 36 is slidedly threaded through wick guide 37 to define a wick tip 36A having a wick height WH (FIGS. 3A and 3B) for developing a flame. Wick guide 37 is fixed to the top of reservoir 34 and defines an exit port for transfer of fuel from reservoir 34 to wick tip 36A through wick 36. The wick height WH is manually adjusted by the user by way of wick raise/lower handle 38. Handle 38 is fixedly attached to wick clamp 39 which, in turn, is slidedly mounted on clamp guide rods 41. As handle 38 is raised and lowered (see arrow 38A in FIG. 3B), the wick height is increased and decreased, respectively. The wick is extinguished due to carbon dioxide build-up by lowering wick 36 below wick guide 37.

To operate preheater 30, handle 38 is raised to allow the wick height to increase until wick tip 36A comes into thermal contact with electric ignitor 42. Electric ignitor 42 (available from Sonictronics Glo-Devil) is powered by battery 43 (FIG. 1) mounted on air intake vent 44 and is activated by ignitor switch 45. Ignitor switch 45 couples the voltage provided by battery 43 (e.g., 3 volts) to electric ignitor 42 so as to cause current to flow through ignitor 42 to electrically heat wick tip 36A until a flame is created. After a flame is created, switch 45 is deactivated. (Valve 64 at the bottom of reservoir 34 is used for draining fuel from reservoir 34 during long-term storage).

Preheater 30 includes a pair of opposing combustor plates 46A and 46B for facilitating the production of a clean-burning (preferably blue) flame. Plates 46A and 46B include an array of holes 47 for allowing air to flow along paths 48A and 48B shown in FIG. 3B. Plates 46A and 46B also concentrate the flame to a restricted area to provide effective transfer of heat from combustor chamber 32A to manifold chamber 32B.

Preferably, the components of preheater 30 are made from lightweight materials (e.g., aluminum or other lightweight alloys). Accordingly, preheater 30 has a total weight of less than about 2 to 4 lbs.

Figure 4:
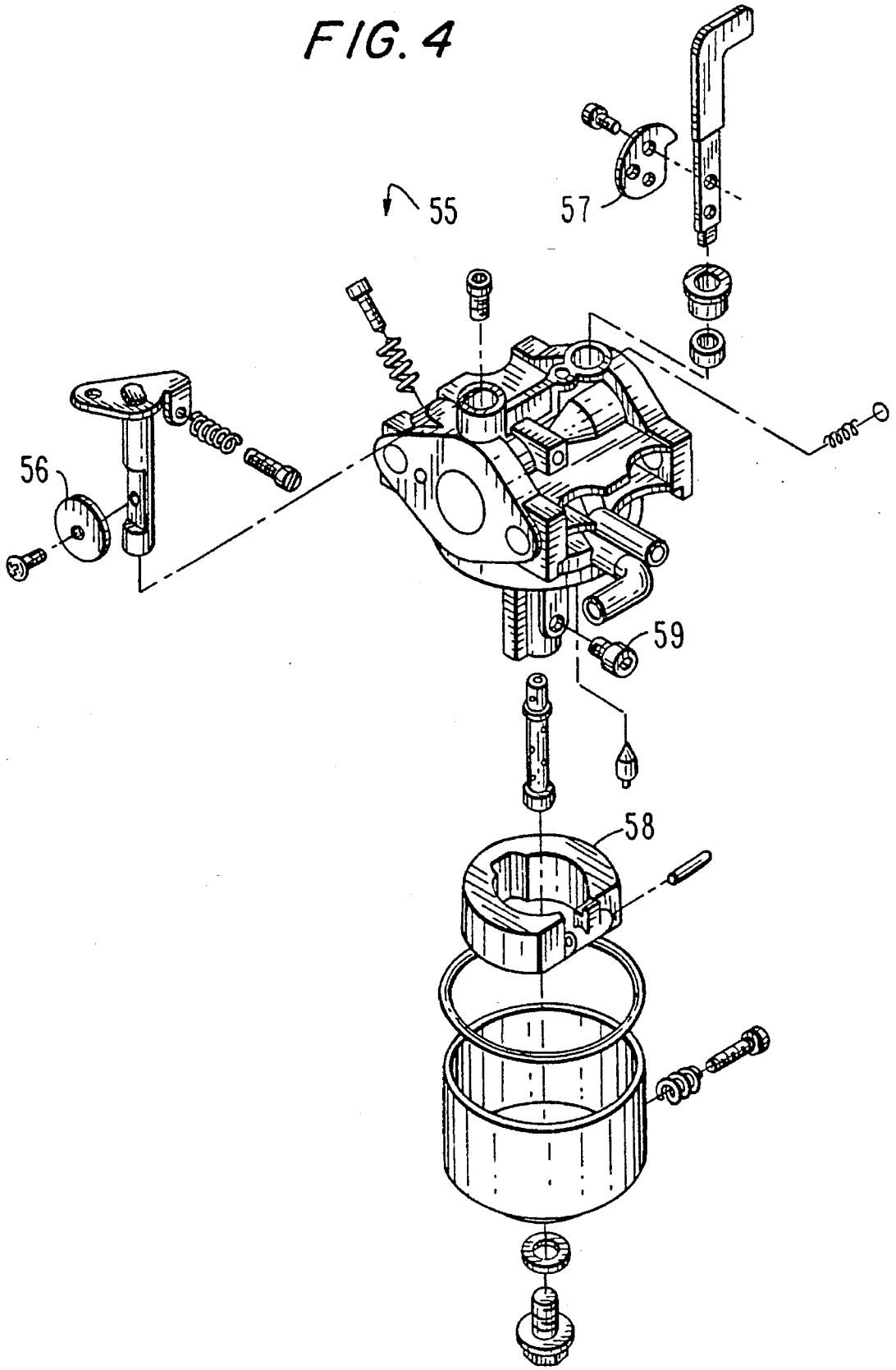
FIG. 4 is an exploded perspective view of the carburetor of the spark-ignited combustion engine of FIG. 2A, taken from line 4—4 of FIG. 2A.

In accordance with the present invention, in addition to modifying manifold 17 to facilitate transfer of heat thereto, other components of engine 20 are modified to be able to smoothly operate the engine with middle distillate fuels, particularly at low temperatures, without significant amounts of white exhaust smoke after engine warm-up (unburned fuel). FIG. 4 is an exploded perspective view of the carburetor of the engine of FIG. 2A, taken from line 4—4 of FIG. 2A. Carburetor 55 includes throttle valve 56, choke valve 57, float 58 and main jet 59 for allowing fuel to mix with air within carburetor 55. Except for main jet 59, the components of carburetor 55 shown in FIG. 4 are conventional. In accordance with the present invention, operation of engine 20 on middle distillate fuels was facilitated by increasing the cross-section of the main jet orifice to approximately 0.028 inch in diameter.

In addition to increasing the cross-section of the main jet orifice, operation is facilitated by replacing the conventional factory spark plug with a hotter, longer reach spark plug, for example, a Champion® RJ18YC6 plug having a 0.060 inch gap. This spark plug has a longer reach into the cylinder chamber which increases the compression ratio and is of a higher heat range design, which reduces "buildup" of deposits on the plug itself and other combustion chamber surfaces. Operation of the engine was also found to be facilitated by using a wholly synthetic crank case lubricating oil, preferably, Mobil 1® 5W-30 synthetic lubricating oil (i.e., one that meets MIL-SPEC-MIL-L-46167). This oil was found to have adequate viscosity characteristics at low and higher temperature (e.g., below 0° C. and to 50° C.).

With the above described modifications, the otherwise gasoline-powered engine is capable of operating on middle distillate fuels. To improve smoothness of operation and reduce combustion "knock" associated with operation at high temperatures (e.g., 50° C.), the following additional changes can be made to minimize knock depending upon the amount of "knock" present in the particular application. Cylinder head cooling can be improved by modifying the cylinder head cooling-air shroud to prevent any leakage of cooling air on its way from the engine air cooling fan to the cylinder head. Cylinder head cooling is also aided by attaching back-pack bracket 13A (or other metallic heat sinks) to the cylinder head which acts as a heat sink to remove heat from the cylinder head. Reducing intake manifold 17 temperature will also reduce engine knock at high temperatures. This is accomplished by installing temperature resistive insulative gaskets between the cylinder block and intake manifold 17 and by placing muffler 8 of the exhaust system as far away from intake manifold 17 as practically possible (depending upon the application) such that radiant heat transfer to the intake system is reduced. Additionally, reducing the exhaust manifold temperature also reduces engine knock at high temperatures. This is accomplished by installing temperature resistive insulative gaskets between the exhaust manifold and the muffler. These heat management means in the areas of the cylinder head provide for reduced engine knocking at high temperatures and result in quieter and more efficient engine operation.

Thus, in accordance with the present invention, the following steps are used to cold-start the engine of the present invention. Preheater fuel control valve 62A and the carburetor fuel control valve are placed in the OPEN position. The engine ignition switch is then placed in the ON position. The carburetor choke is fully closed. Using the manual recoil, the engine is "pulled-over" four to five times (ten times after long-term storage) to draw fuel into the intake manifold where it is to be vaporized by the preheater. Wick 36 is raised by wick raise/lower handle 38 until it comes into contact with electric ignitor 42. Preheater ignition switch 45 is held in the ON position for 3 to 4 seconds until wick tip 36A is ignited by electric ignitor 42. After preheater 30 has operated for approximately three to five minutes, the engine is started by pulling rapidly on the manual recoil. The carburetor choke is then opened a small amount to allow the engine to operate smoothly. After two to three minutes of engine operation, the choke is adjusted to the half-open position. The preheater wick is then lowered to turn the preheater off. After a load is placed on the engine, the carburetor choke is adjusted to fully OPEN.

Figure 5:
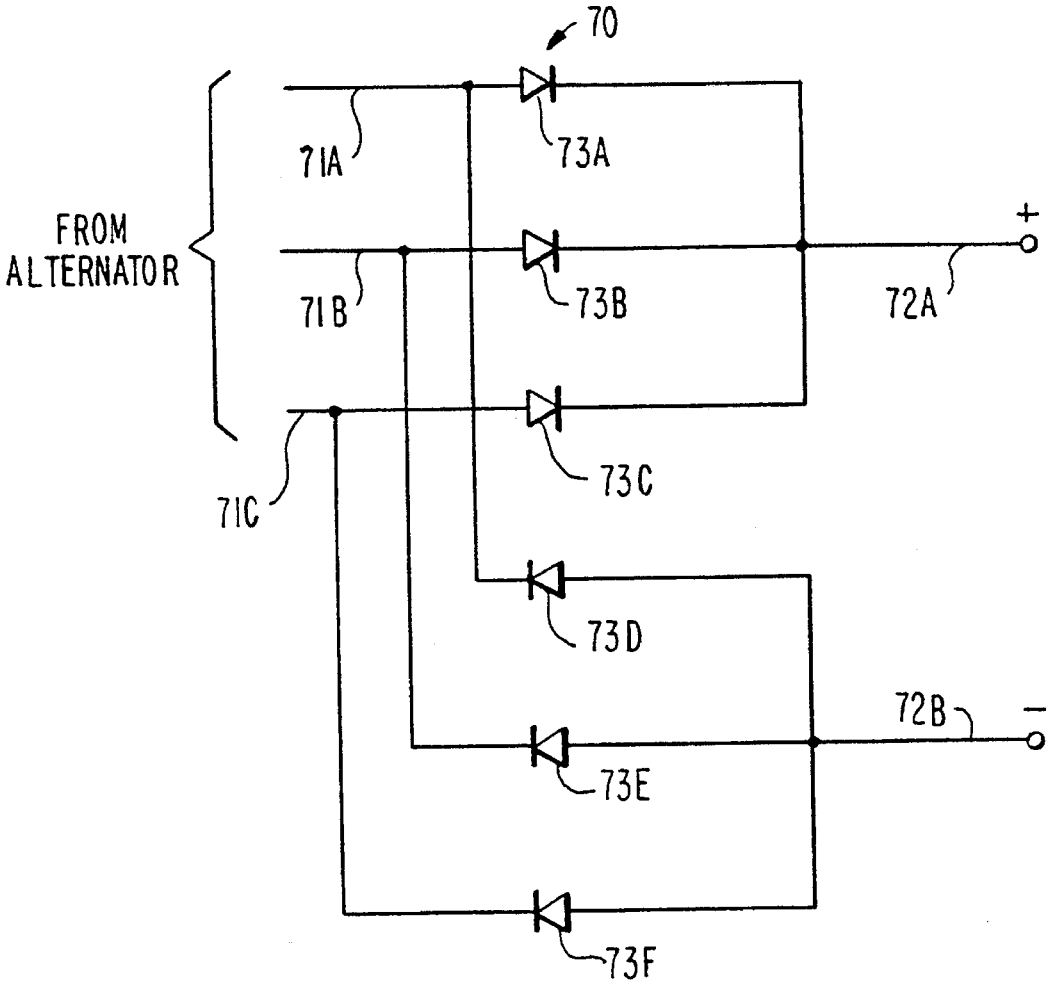
FIG. 5 is schematic diagram of an embodiment of an output circuit for use with an embodiment of the back-pack generator set of the present invention.

As discussed above, the generator set of the present invention can include a conventional generator (e.g., a Dayton® generator) or, preferably, an alternator having a design as disclosed in above-incorporated U.S. Pat. Nos. 4,900,965 and 5,212,419 or application Ser. No. 08/138,242. In accordance with the present invention, the output circuitry of the generator set can be any circuitry suitable for the particular application of the generator set (e.g., a D.C. or A.C.-generating output circuit). FIG. 5 is a schematic diagram illustrating an output circuit suitable for coupling to an alternator design as shown in above-incorporated patent application Ser. No. 08/138,242 for generating a rated output of 500 W at 28 Volts (D.C.). As shown in FIG. 5, output circuit 70 includes (a) three input lines 71A, 71B and 71C for coupling to the respective phases of the alternator output leads (not shown) and (b) two output lines 72A and 72B for providing the output voltage. Coupled between the input and output lines of output circuit 70 are six diodes 73A–F forming a rectifier output circuit. Of course, other output circuits could just as well be used depending upon the particular application for the generator set. For example, for the Dayton® generator shown in FIGS. 1–4, the output circuit, which is sold with the generator unit, is capable of providing 120 volt, single phase, 60 Hz output power.

In addition to including various types of alternator designs, the present invention also includes various types of engine designs. For example, although the invention has been discussed above with reference to a particular model of a Kawasaki® engine, other similar types and models of engines could just as well be used as long the steps described herein for modifying the gasoline-powered engine are applicable thereto. For example, such engines include multi-cylinder and multi-stroke engines. Accordingly, the present invention also includes the particular method described herein for convening a conventional gasoline-fueled spark-ignited engine to run on middle distillate fuels and includes the following steps.

First, a manifold preheater is added to provide heat to the intake manifold during initial start-up and operation of the engine. Second, the orifice cross-section of the main jet of the carburetor is increased to accommodate the change from gasoline to a middle distillate fuels. Third, a longer reach, high temperature heat-range, spark plug(s) is added to enhance combustion and reduce "build-up" of deposits on the plug itself and other combustion chamber surfaces. Four, a wholly synthetic crank case lubricating oil is added to provide adequate viscosity at low temperature to facilitate cold temperature start-up and be able to provide a reasonable viscosity compatibility over a large temperature range. Lastly, a means of cooling the cylinder head(s) is provided (i.e., thermal management) to prevent engine knocking during high-temperature operation.

The above method of the present invention has been successful in convening a 1-cylinder, 4-stroke, air-cooled gasoline engine to operate on a middle distillate fuel (e.g., JP-5, JP-8 and F-34) which has smoothly and quietly operated without significant amounts of white exhaust smoke (unburned fuel) after warm-up and which has been successfully cold-started at temperatures as low as about zero to negative 10° C. In contrast to the prior an attempts to convert spark-ignited gasoline engines to operate on middle distillate fuels, the following steps were not found necessary herein. (1) The insertion of multiple head gaskets; removing material from the combustion chamber; removing metal from the piston; or using internal chambers in the piston; all of which are intended to reduce the compression ratio. (2) Redesigning pistons rings for reducing "crankcase oil dilution." (3) Retarding the ignition timing from 2 to 6 crank angle degrees from normal timing. (4) Fuel heating techniques using engine exhaust heat to bring the middle distillate fuel closer to its vaporization temperature during continuous operation. (5) The use of gasoline or starting fluid for initially starting the engine. In contrast to the prior art methods, the method of the present invention is simple, inexpensive and easy to implement.

Although the generator sets described above illustrate particular embodiments of the present invention capable of providing a rated output of at least 500 W's with a total weight in the range from about 25–30 lbs. to about 45–50 lbs., other embodiments are just as well within the scope of the present invention. For example, alternators made in accordance with the designs described in above-incorporated U.S. Pat. Nos. 4,900,965 and 5,212,419 and application Ser. No. 08/138,242 and having rated power outputs of 1, 1.5, 2 and 3 kW's can be made having weights of about 6, 9, 11 and 14 lbs, respectively; moreover, modified spark-ignited engines made in accordance with the present invention for use with such alternators would have weights of approximately 19, 22, 29 and 40 lbs., respectively; thus, portable generators in accordance with the present invention can be made having weights of about 30, 36, 45 and 59 lbs., respectively (assuming the preheater and back-pack/support frame weigh about 5 lbs. together), for such rated output powers, respectively.

In addition, although the spark-ignited engine described herein is illustrated with one particular type of intake manifold preheater, other types of preheaters for providing heat to the intake manifold are just as well within the scope of the present invention as long as such preheaters are capable of rapidly and safely heating the intake manifold to facilitate start-up of the engine. For example, intake manifold heat can be provided by employing a jet-like nozzle in combination with a pressurized tank (coupled to the engine fuel tank) for producing a "torch-like" source of flame. In addition, electrical heating of the intake manifold could just as well be used. For this embodiment of the present invention, the electrical power could be provided by an electrical battery or any other source of electrical power.

Although the generator set has been illustrated above with reference to FIG. 1 showing a "back-pack" holder as the portable carrying means for the engine/alternator unit, other types of carrying means are also within the scope of the present invention. For example, a hand-held carrier having one or more hand grips could be used, just as well any other carrier means or framing support capable of adequately mounting the engine/alternator unit. For what ever type of carrying means or framing support is used, it is preferable that the center of mass of the engine/alternator unit is centered with respect to such means or support to facilitate portable operation.

Thus, a lightweight generator set capable of operating on middle distillate fuel has been provided. One skilled in the art will appreciate that the present invention can be practiced by other than the described embodiments, which are presented here for purposes of illustration and not of limitation, and that the present invention is limited only by the claims that follow.

What is claimed is:

1. A lightweight, back-pack generator set comprising:

a back-pack frame having a means for attaching an engine and an alternator to said frame and adapted for carrying said generator set;

the engine being adapted to operate on a middle distillate fuel and comprising:

a spark-ignited internal combustion engine including a spark plug and a drive shaft rotatable by the engine;

an engine fuel reservoir for containing the middle distillate fuel;

a carburetor for mixing air with the distillate fuel and having an outlet and an inlet coupled to the engine fuel reservoir;

a manifold coupled between the carburetor outlet and a cylinder chamber for providing the air-fuel mixture to the cylinder chamber;

a means for starting the engine; and a preheater for heating the manifold to facilitate start-up of the engine to cause the drive shaft to rotate, wherein the preheater heats the air-fuel mixture so that the spark plug ignites the middle distillate fuel during start-up; and the alternator having a rotor coupled to said drive shaft for converting the mechanical rotational motion of the drive shaft into electrical energy.

2. The generator set of claim 1, wherein the preheater includes:

a preheater fuel reservoir coupled to the engine fuel reservoir for containing an amount of middle distillate fuel;

a chamber in thermal contact with said manifold; and a wick disposed in both said preheater fuel reservoir and said chamber for providing a flame in said chamber to heat said manifold.

3. The generator set of claim 2, wherein the preheater further includes an electric ignitor for igniting said wick.

4. The generator set of claim 1, wherein the generator set is capable of providing over 500 Watts of electrical power and has a total weight in the range from about 25 lbs. to about 50 lbs.

5. The generator set of claim 1, wherein the generator set is capable of providing over 500 Watts of electrical power and wherein the alternator has a weight of less than about 10 lbs.

6. The generator set of claim 1, wherein the generator set is capable of providing over 500 Watts of electrical power and has a total weight in the range from about 25 lbs. to about 50 lbs. and wherein the engine is capable of starting on said middle distillate fuel at temperatures less than about 0° C.

7. The generator set of claim 1, wherein the generator set is capable of providing over 500 Watts of electrical power and has a total weight in the range from about 25 lbs. to about 50 lbs. and wherein the engine has a combustion chamber originally designed to operate on conventional gasoline.

8. The generator set of claim 1, wherein the middle distillate fuel is selected from the group consisting of JP-5, JP-8 and F-34 types of fuel.

9. The generator set of claim 1, wherein the engine is a 1-cylinder, 4-stroke, air-cooled engine.

10. The generator set of claim 1, wherein the generator set is capable of providing over 1,000 Watts of electrical power and has a total weight less than about 45 lbs.

11. The generator set of claim 1, wherein the generator set is capable of providing over 1,000 Watts of electrical power and wherein the alternator has a weight of less than about 10 lbs.

12. The generator set of claim 1, wherein the generator set is capable of providing over 1,000 Watts of electrical power and has a total weight less than about 45 lbs. and wherein the engine is capable of starting on said middle distillate fuel at temperatures less than about 0° C.

13. The generator set of claim 1, wherein the generator set is capable of providing over 1,000 Watts of electrical power and has a total weight less than about 45 lbs. and wherein the engine has a combustion chamber originally designed to operate on conventional gasoline.

14. The generator set of claim 1, wherein the preheater comprises a means for providing a flame to heat said manifold.

15. The generator set of claim 1, wherein the preheater comprises a means for electrically heating said manifold.

16. The generator set of claim 1, wherein the alternator includes an output circuit for providing a D.C. voltage of about 28 volts.

17. The generator set of claim 1, wherein the alternator includes an output circuit for providing an A.C. output voltage of about 120 volts at about 60 Hz.

18. A lightweight, portable generator set comprising:

a supporting frame having a means for attaching an engine and an alternator to said frame and adapted for carrying said generator set;

the engine being adapted to operate on a middle distillate fuel and comprising:

a spark-ignited internal combustion engine including a spark plug and a drive shaft rotatable by the engine;

an engine fuel reservoir for containing the middle distillate fuel;

a carburetor for mixing air with the distillate fuel and having an outlet and an inlet coupled to the engine fuel reservoir;

a manifold coupled between the carburetor outlet and a cylinder chamber for providing the air-fuel mixture to a cylinder chamber;

a means for starting the engine; and a preheater for heating the manifold to facilitate the start-up of the engine to cause the drive shaft to rotate, wherein the preheater heats the air-fuel mixture so that the spark plug ignites the middle distillate fuel during start-up; and the alternator having a rotor coupled to said drive shaft for converting the mechanical rotational motion of the drive shaft into electrical energy.

19. The generator set of claim 18, wherein the generator set is capable of providing over 500 Watts of electrical power and has a total weight less than about 50 lbs. and wherein said supporting frame is attached to said engine adjacent the cylinder head area to act as a heat sink to reduce engine knocking.

20. The generator set of claim 18, wherein the generator set is capable of providing over 500 Watts of electrical power and wherein the alternator has a weight of less than about 10 lbs.

21. The generator set of claim 18, wherein the generator set is capable of providing over 500 Watts of electrical power and has a total weight less than about 50 lbs. and wherein the engine is capable of starting on said middle distillate fuel at temperatures less than about 0° C.

22. The generator set of claim 18, wherein the generator set is capable of providing over 500 Watts of electrical power and has a total weight less than about 50 lbs. and wherein the engine has a combustion chamber originally designed to operate on conventional gasoline.

23. The generator set of claim 18, wherein the middle distillate fuel is selected from the group consisting of JP-5, JP-8 and F-34 types of fuel.

24. The generator set of claim 18, wherein the engine is a 1-cylinder, 4-stroke, air-cooled engine.

25. The generator set of claim 18, wherein the generator set is capable of providing over 1,000 Watts of electrical power and has a total weight less than about 45 lbs.

26. The generator set of claim 18, wherein the generator set is capable of providing over 1,000 Watts of electrical power and wherein the alternator has a weight of less than about 10 lbs.

27. The generator set of claim 18, wherein the generator set is capable of providing over 1,000 Watts of electrical power and has a total weight less than about 45 lbs. and wherein the engine is capable of starting on said middle distillate fuel at temperatures less than about 0° C.

28. The generator set of claim 18, wherein the generator set is capable of providing over 1,000 Watts of electrical power and has a total weight less than about 50 lbs. and wherein the engine has a combustion chamber originally designed to operate on conventional gasoline.

29. The generator set of claim 18, wherein the generator set is capable of providing over 1,500 Watts of electrical power and has a total weight less than about 50 lbs.

30. The generator set of claim 18, wherein the generator set is capable of providing over 1,500 Watts of electrical power and wherein the alternator has a weight of less than about 15 lbs.

31. The generator set of claim 18, wherein the generator set is capable of providing over 1,500 Watts of electrical power and has a total weight less than about 50 lbs. and wherein the engine is capable of starting on said middle distillate fuel at temperatures less than about 0° C.

32. The generator set of claim 18, wherein the generator set is capable of providing over 1,500 Watts of electrical power and has a total weight less than about 50 lbs. and wherein the engine has a combustion chamber originally designed to operate on conventional gasoline.

33. The generator set of claim 18, wherein the generator set is capable of providing over 2,000 Watts of electrical power and has a total weight less than about 60 lbs.

34. The generator set of claim 18, wherein the generator set is capable of providing over 2,000 Watts of electrical power and wherein the alternator has a weight of less than about 15 lbs.

35. The generator set of claim 18, wherein the generator set is capable of providing over 2,000 Watts of electrical power and has a total weight less than about 60 lbs. and wherein the engine is capable of starting on said middle distillate fuel at temperatures less than about 0° C.

36. The generator set of claim 18, wherein the generator set is capable of providing over 2,000 Watts of electrical power and has a total weight less than about 60 lbs. and wherein the engine has a combustion chamber originally designed to operate on conventional gasoline.

37. The generator set of claim 18, wherein the preheater comprises a means for providing a flame to heat said manifold.

38. The generator set of claim 18, wherein the preheater comprises a means for electrically heating said manifold.

39. The generator set of claim 18, wherein the alternator includes an output circuit for providing a D.C. voltage of about 28 volts.

40. The generator set of claim 18, wherein the alternator includes an output circuit for providing an A.C. output voltage of about 120 volts at about 60 Hz.

41. A lightweight engine comprising:

a spark-ignited internal combustion engine having a spark plug and being originally designed to operate on conventional gasoline and subsequently adapted to operate on a middle distillate fuel and comprising:

a drive shaft rotatable by the engine;

an engine fuel reservoir for containing the middle distillate fuel;

a carburetor for mixing air with the distillate fuel and having an outlet and an inlet coupled to a fuel tank;

a manifold coupled between the carburetor outlet and a cylinder chamber for providing the air-fuel mixture to a cylinder chamber;

a means for starting the engine;

a means for cooling the cylinder head area to reduce engine knocking; and a preheater for heating the manifold to facilitate the start-up of the engine to cause the drive shaft to rotate, wherein the preheater heats the air-fuel mixture so that the spark plug ignites the middle distillate fuel during start-up.

42. The engine set of claim 41, wherein the preheater includes:

a preheater fuel reservoir coupled to the engine fuel reservoir for containing an amount of middle distillate fuel;

a chamber in thermal contact with said manifold; and a wick disposed in both said preheater fuel reservoir and said chamber for providing a flame in said chamber to heat said manifold.

43. The engine of claim 41, wherein the preheater further includes an electric ignitor for igniting said wick.

44. The engine claim 41, wherein the preheater comprises a means for providing a flame to heat said manifold.

45. The engine of claim 41, wherein the preheater comprises a means for electrically heating said manifold.

46. The engine of claim 41, wherein the means for cooling the cylinder head area comprises a metallic heat sink attached to said area.

47. A method of converting a lightweight, gasoline-powered internal combustion engine to operate on a middle distillate fuel, the gasoline-powered internal combustion engine including an intake manifold, a conventional crank case lubricating oil, a conventional spark plug adapted for igniting gasoline, a cylinder head and a carburetor for mixing air with fuel and having a main jet, the method comprising the steps of:

(a) attaching a preheater to the intake manifold to heat said manifold prior to start-up of the engine to facilitate said start-up, wherein the preheater is adapted to heat the air, fuel mixture so that the spark plug ignites the middle distillate fuel during start-up;

(b) replacing the conventional spark plug with a longer-reach spark plug with a high-temperature heat range;

(c) increasing the cross-sectional area of the carburetor main jet;

(d) replacing the conventional crank case lubricating oil with a wholly synthetic crank case lubricating oil; and (e) providing additional cooling to the cylinder head area to reduce engine knocking.

48. The method of claim 47, wherein the preheater comprises a means for providing a flame to heat said manifold.

49. The method of claim 47, wherein the preheater comprises a means for electrically heating said manifold.

50. The method of claim 47, wherein the step of providing additional cooling to the cylinder head area comprises adding a metallic heat sink to said area.

* * * * *